United States Patent [19]

Whitman et al.

[11] Patent Number: 4,861,298

[45] Date of Patent: Aug. 29, 1989

[54] ACTUATION SYSTEM FOR AN ENCAPSULATING LIFE RAFT

[75] Inventors: Gary R. Whitman, Holland; Daniel S. McCauley, Roslyn, both of Pa.

[73] Assignee: The United States of America as represented by the Secretary of the Navy, Washington, D.C.

[21] Appl. No.: 210,893

[22] Filed: Jun. 24, 1988

[51] Int. Cl.[4] ..... B63C 9/24

[52] U.S. Cl. ..... 441/42

[58] Field of Search ..... 441/38, 40–44, 441/83, 87; 141/19

[56] References Cited

U.S. PATENT DOCUMENTS

| | | | |
|---|---|---|---|
| 2,444,717 | 7/1948 | Allen | 441/41 |
| 3,165,763 | 1/1965 | Gaylord | 441/41 |
| 3,182,928 | 5/1965 | Gaylord | 441/42 |
| 3,610,470 | 10/1971 | Waters | 441/41 |
| 3,709,044 | 1/1973 | Chacko | 441/41 |
| 3,768,761 | 10/1973 | Cramer | 441/42 |
| 3,782,413 | 1/1974 | Chacko | 441/41 |
| 4,187,570 | 2/1980 | DeSimone | 441/42 |
| 4,355,987 | 10/1982 | Miller | 441/42 |

*Primary Examiner*—Joseph F. Peters, Jr.
*Assistant Examiner*—Jesûs D. Sotelo
*Attorney, Agent, or Firm*—John M. O'Meara; Susan E. Verona

[57] ABSTRACT

An actuation system for a two-section encapsulating life raft system is provided which includes a manually releasable spring-biased linkage assembly that normally serves to link a cable from the pressurized source for the encapsulating raft section and a cable for automatically actuating both the main raft section and the encapsulating section. Furthermore, by a simple manual operation, the linkage assembly undergoes rapid disassembly, and the cable for the pressurized source is disconnected from the actuating cable. A spring in the spring-biased assembly is compressed to store energy during connection of the assembly to the pressurized source cable, and the spring is retained in a compressed state as long as the linkage function is maintained. A manually removable retention pin is provided that normally retains the spring in the compressed state to retain the linkage function. However, when the retention pin is manually removed from the linkage retention position, the energy from the compressed spring is released, and the linkage assembly positively disassembles and disconnects the cable from the pressurized gas source from the linkage assembly. By breaking connection between the cable for the pressurized source and the linkage assembly, the cable for the pressurized source is disconnected from the actuation cable, thereby preventing the encapsulating raft section from being inflated.

14 Claims, 3 Drawing Sheets

ACTUATION SYSTEM FOR AN ENCAPSULATING LIFE RAFT

Statement of Government Interest

The invention described herein may be manufactured and used by or for the Government of the United States of America for governmental purposes without the payment of any royalties thereon or therefor.

BACKGROUND OF THE INVENTION

The present invention relates to the field of life rafts for personnel who exit an aircraft in an emergency situation over a body of water. More specifically, the invention relates to inflatable life rafts that are inflated by pressurized gases stored in gas cylinders which are actuated to release their stored gases to the inflatable rafts. The invention especially relates to an inflatable encapsulating life raft system for use by aviators who eject from an aircraft.

Two-section life rafts which encapsulate a person and protect the person from the water after escape from a ship in an emergency situation are known and are disclosed in U. S. Pat. Nos. 4,187,570 and 4,355,987. A main flotation section provides primary flotation for the user, and an encapsulation section provides additional protection to the user from the water. With such known life rafts, both the main flotation section and the encapsulating section inflate simultaneously without giving the person an option to selectively inflate the main section without inflating the encapsulating section.

More specifically with respect to U. S. Pat. Nos. 4,355,987, an inflatable life raft having two separate pressurized gas sources and two separate inflatable sections is disclosed. The two separate inflatable sections serve a safety measure providing redundancy in case one of the inflatable sections is incapable of remaining inflated due to the presence of a hole or ruptured seam or the like. An important consideration in the design of the life raft disclosed in said patent is the provision of an actuation mechanism that guarantees that both sections of the life raft are actuated. The actuation mechanism in said patent does not provide for selective inflation of just one raft section or, alternatively, both raft sections at separate times at the choosing of the personnel using the raft.

Such known encapsulating life raft systems are not suitable for use by an aviator who ditches his aircraft in a body of water because an aviator needs to have the option of inflating only the main section first and then later inflating the encapsulating section after the aviator has climbed out of the water into the main section.

More specifically with respect to an aviator, if an ejection seat is ejected from the aircraft at a sufficient altitude to allow time to deploy a liferaft after deployment of a parachute, then both inflatable sections can be automatically inflated during parachute descent. During parachute descent, the aviator is secured in close proximity to the main flotation section; and the main flotation section is oriented with respect to the aviator to deploy behind the aviator during descent. During parachute descent, the encapsulating section deploys in front of the aviator so that when the aviator reaches the water from a parachute descent, he is encapsulated by the two sections of the system.

However, if the aviator ejects from the aircraft at an altitude that is too low to deploy the raft during parachute descent or if the aviator ditches the aircraft in the water and then leaves the aircraft, then inflation of the raft should be delayed until entry of the aviator into the water, and the kit containing the raft is detached from the aviator. More specifically, when the aviator enters the water, he would detach the raft container from his body and preferably first inflate the main flotation section. Then the aviator would climb into or board the main flotation section. Finally, once in the main flotation section, the aviator would then inflate the encapsulating section. Furthermore, the aviator should be able to decide when to bring about inflation of the raft sections independently. It would be difficult for the aviator to board a previously fully deployed encapsulating life raft system while the aviator is outside the raft in the water. Therefore, when the aviator does not deploy the raft during parachute descent, the aviator, when in water, should be able to inflate the main flotation section and inflate the encapsulating section independently of one another. For inwater deployment, the aviator should be able to manually actuate inflation of the main section and independently manually actuate the encapsulating section if desired.

SUMMARY OF THE INVENTION

It is an object of the present invention to provide an actuation mechanism for automatic inflation of two life raft sections when an aviator is ejected from an aircraft and descends to a body of water by parachute wherein the mechanism also permits the aviator to selectively inflate only one life raft section when the life raft is deployed in water.

Another object is to provide an actuation system for a life raft that provides a consistent and reliable disengaging force for disengaging an unused lanyard from an encapsulating gas source.

Briefly, these and other objects are accomplished by a novel actuation system for a two-section inflatable raft system for an aviator equipped with a parachute. The actuation system includes a stored-energy releasable linkage assembly that provides a connection or linkage between a source of pressurized gas for inflating an encapsulating raft section and an actuating lanyard that is automatically actuated during parachute descent. The stored-energy releasable linkage assembly includes an energy storing means that is retained in a stored energy state and also includes a retention pin for maintaining linkage to the encapsulating section pressurized source. Both the energy storing means and the retention pin are retained in their linkage maintenance position by a removable hitch pin located in a linkage retention position on the retention pin. During assembly of the stored-energy releasable linkage assembly, a loop end of a cable for actuating the encapsulating gas source is looped around the retention pin member and is retained by the retention pin member as long as the linkage assembly remains in the linkage maintenance condition. When the removable hitch pin is retained in the linkage retention position, the encapsulating raft section is automatically inflated along with a main raft section during parachute descent.

However, when the aviator does not deploy the raft during parachute descent, then he can inflate the raft sections manually when desired in water. More specifically, when the removable hitch pin is manually removed from the linkage retention position on the retention pin member, the energy storing means is permitted to release its stored energy, the retention pin member is expelled from the linkage assembly, the looped end of the cable for actuating the encapsulating gas source is separated from the retention pin member, and the encapsulating gas source is disconnected from an actuation lanyard; and, thereby, the encapsulating section is prevented from being inflated. At the same time the encapsulating section actuation lanyard is disconnected from the encapsulating gas source, another actuation lanyard actuates the main raft section. Thus, the aviator can manually inflate the main raft section without inflating the encapsulating section. If desired, the aviator can manually inflate the encapsulating section at a later time.

Preferably, the energy storing means includes an energy storing compressed spring. The stored-energy releasable linkage assembly also includes a rigid fork member including two arms. Each of the arms includes an aperture, and both of the apertures are in alignment for receipt of a rigid retention pin member which is inserted through the apertures. The retention pin member includes a first end which includes a pin hole adapted to receive the removable hitch pin. The pin hole extends out past the aperture of one of the fork arms when the removable hitch pin is in the linkage retention position. The removable hitch pin is retained in the hole and prevents the retention pin member from moving out of its retained position in the fork member arm. The retention pin member also includes a shaft portion and a second end which includes a head portion adapted to retain the spring member.

During assembly of the linkage assembly, the spring is placed over the retention pin member with one end of the spring being retained by the head portion of the retention pin. The pin hole end and the shaft are pushed through the aperture in one fork arm thereby partially compressing the spring. When the pin hole end of the retention pin is located between the arms of the fork member, the pin hole end of the retention pin is passed through the loop end of the cable for actuating the encapsulating gas source thereby linking the linkage assembly with the pressurized gas source. The retention pin member is then pushed further and through the aperture on the second fork arm thereby further compressing the spring retained between the retention pin head and the first fork arm. Once the pin hole end of the retention pin member clears the aperture of the second fork arm, the removable hitch pin is placed in position in the pin hole end, thereby locking the retention pin in a linkage retention position whereby the spring is retained in a compressed state.

However, when the removable hitch pin is removed from the linkage retention position, the spring member is released from its compressed state, and it propels the retention pin member away from the fork member, whereby the retention pin member slides out of contact with the loop end of the cable for actuating the encapsulating gas source, and the encapsulating gas source is disconnected from the actuating lanyard that is automatically actuated during parachute descent.

The compressed spring member provides a consistent and reliable disengaging force for disengaging an unused encapsulation lanyard from an encapsulating gas source.

Furthermore, the actuation system of the invention provides an actuation mechanism for automatic inflation of two life raft sections when an aviator is ejected from an aircraft and descends to a body of water by parachute; and the system of the invention also permits the aviator to selectively inflate only one life raft section when the life raft is deployed in water.

Another advantage of the subject actuation system is that it is compatible with vacuum packaging which is a desirable form of packaging.

In accordance with another aspect of the invention, an apparatus is provided for selectively actuating one or two outputs. The apparatus includes a primary actuating means connected to both outputs and capable of actuating both of the outputs when the primary actuating means is actuated. The primary actuating means includes a first lanyard including a first output control end connected to the first output; and a primary tensioning end connected to a source of primary force creating tension in said first lanyard.

The primary actuating means also includes a second lanyard including a second output control end connected to the second output; a primary tensioning end connected to the source of primary force creating tension in said second lanyard; and a stored-energy releasable linkage assembly located between the second output and the second arm member output control end. The stored-energy releasable linkage assembly includes a removable hitch pin normally located in a linkage retention position.

The apparatus for selective actuation of one or two outputs also includes secondary actuating means connected to only the first output and capable of actuating only the first output. The secondary actuating means is also capable of removing the removable hitch pin from the linkage retention position. The secondary actuating means includes a first lanyard including a first output control end connected to the first output and including a secondary tensioning end connected to a source of secondary force creating tension in the first lanyard.

The secondary actuating means also includes a second lanyard including a removable hitch pin end connected to the removable hitch pin and includes a secondary tensioning end connected to a source of secondary force creating tension in the second lanyard, whereby when the removable hitch pin is moved from the linkage retention position, the second output is disconnected from the stored-energy releasable linkage assembly and the second lanyard thereby prevents actuation and operation of the second output.

Other objects, advantages and novel features of the invention will become apparent from the following detailed description of the invention when considered in conjunction with the accompanying drawings herein.

DESCRIPTION OF THE PREFERRED EMBODIMENTS

Figure 1:
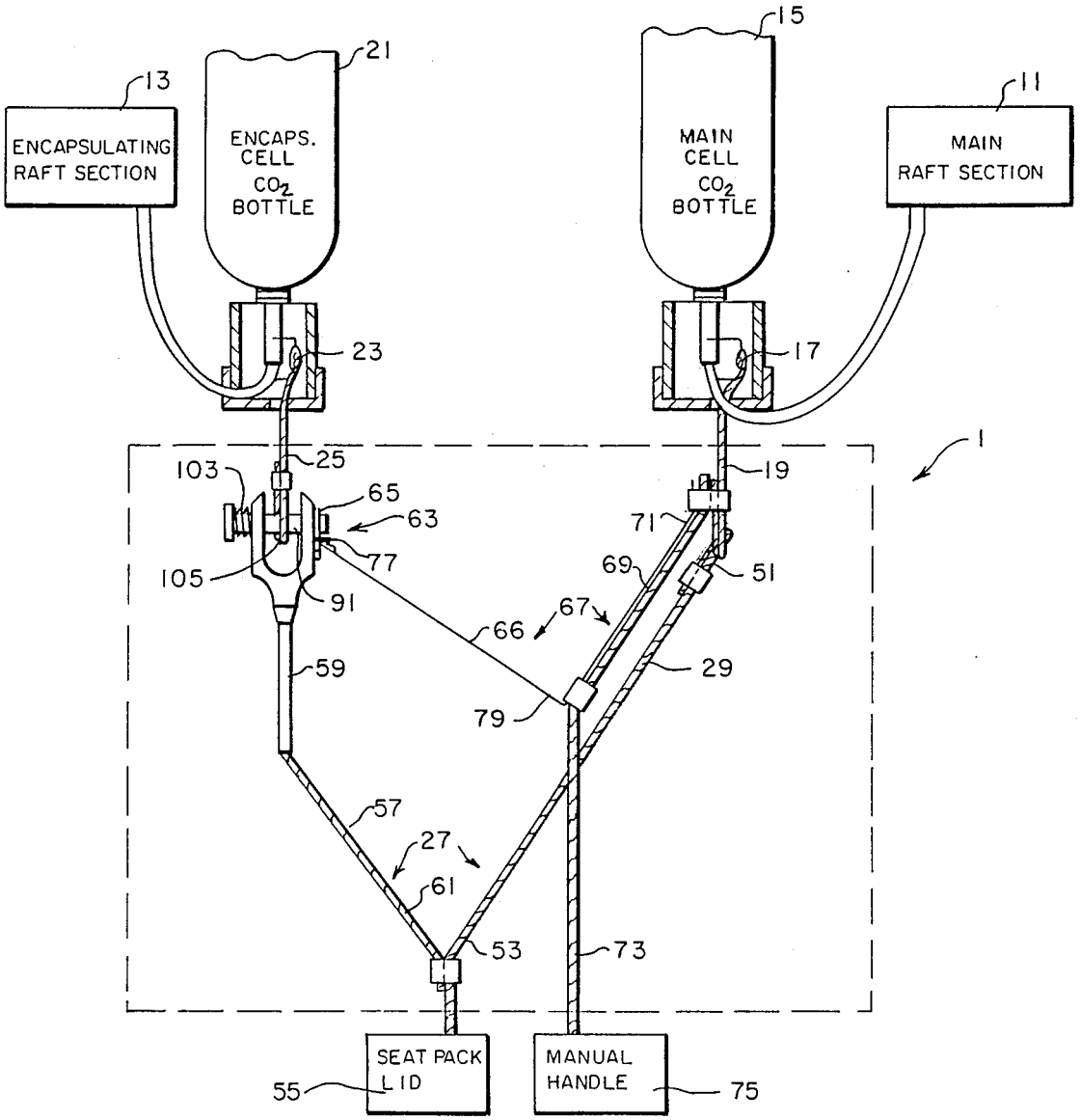
FIG. 1 is a schematic diagram of an embodiment of an actuation system of the invention.
Figure 4:
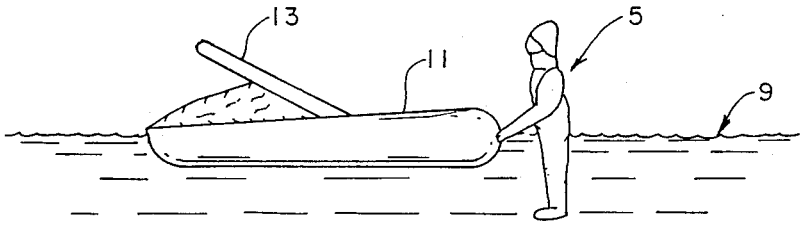
FIG. 4 is a representation of an on-water deployment of a main flotation section actuated by the invention.
Figure 3:
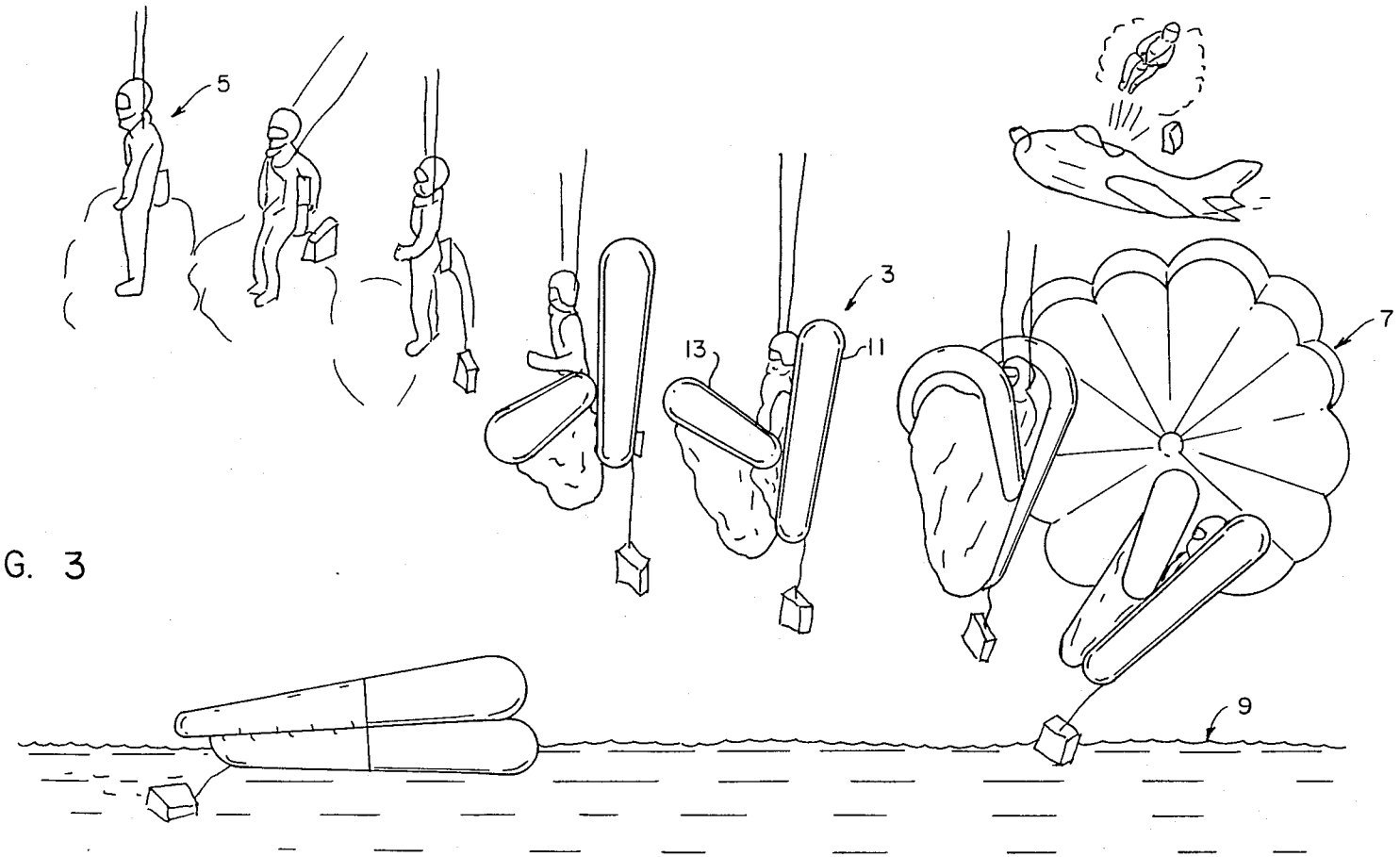
FIG. 3 is a representation of a parachute deployment of a two-section encapsulating raft actuated by the invention.

With reference to the drawings, and more particularly to FIG. 1, there is disclosed a preferred embodiment of the actuation system 1 of the present invention for a two-section encapsulating raft system 3 shown in FIGS. 3 and 4 showing parachute deployment and on-water deployment, respectively. An on-water deployment would occur if the aviator ditches the aircraft in the water or if the aviator ejects from the aircraft at an altitude too low for raft deployment during parachute descent.

As shown in FIG. 3, the two-section inflatable raft system 3 is for an aviator 5 descending by parachute 7 toward a body of water 9. The two-section raft 3 includes a main flotation section 11 and an encapsulating section 13.

Referring to FIG. 1, inflatable raft system includes a main pressurized gas source 15, the main inflatable raft section 11 (shown schematically), a first valve 17 for permitting communication between the main pressurized gas source 15 and the main inflatable raft section 11, and a first valve control cable 19 for controlling the first valve 17. The inflatable raft system also includes an encapsulating pressurized fluid source 21, the encapsulating inflatable raft section 13 (shown schematically), a second valve 23 for permitting communication between the encapsulating pressurized fluid source 21 and the encapsulating inflatable raft section 13, and a second valve control cable 25 for controlling the second valve 23.

More specifically, the preferred embodiment of the actuation system 1 of the invention includes a primary actuating means 27 capable of actuating both the first valve control cable 19 and the second valve control cable 25 when the aviator descends with a parachute. The primary actuating means 27 includes a first arm member 29, such as lanyard 29, including a valve control end 51 connected to the first valve control cable 19 and includes a primary tensioning end 53 connected to a source of primary force 55 creating tension in said first arm member 29 during parachute descent. The source of primary force 55 is generated by the free fall of the raft container lid released during parachute descent.

The primary actuating means 27 also includes a second arm member 57, such as lanyard 57, including a valve control end 59 connected through a stored-energy linkage assembly 63 to the second valve control cable 25. The second arm member also includes a primary tensioning end 61 connected to the source of primary force 55 creating tension in the second arm member 57.

A retention pin member 91 of the linkage assembly 63 retains a looped end 105 of the second control cable 25. The stored-energy releasable linkage assembly 63 includes a removable hitch pin 65 located in a linkage retention position as shown in FIG. 1. As long as the removable hitch pin 65 is retained in the linkage retention position, the main and encapsulating raft sections can be inflated simultaneously during parachute descent of the aviator.

The actuating system 1 of the invention also includes a secondary actuating means 67 capable of actuating the first valve control cable 19 and capable of removing the removable hitch pin 65 from the linkage retention position. The secondary actuating means 67 includes a first arm member 69, lanyard 69, including a valve control end 71 connected to the first valve control cable 19 and a secondary tensioning end 73 connected to a source of secondary force 75 (preferably, a manually operated handle 75) creating tension in the first arm member 69. The secondary actuating means 67 also includes a second arm member 66 (e.g. wire 66) including a removable hitch pin end 77 connected to the removable hitch pin 65 and including a secondary tensioning end 79 connected to the source of secondary force 75 creating tension in the second arm member.

Figure 2:
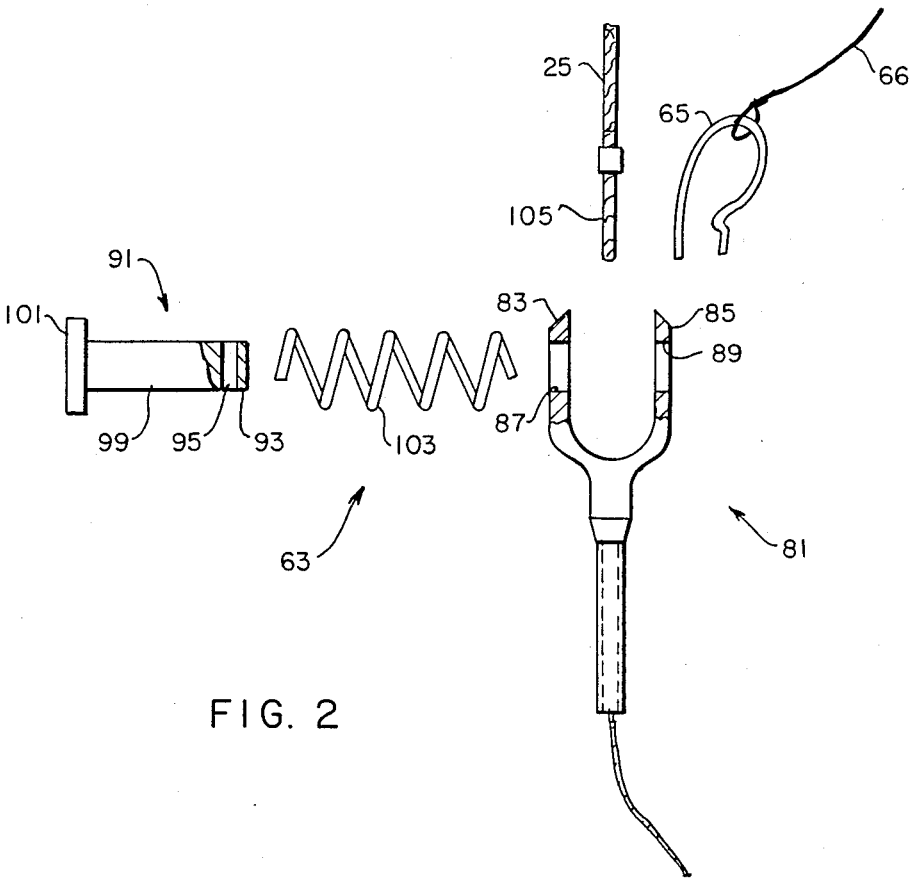
FIG. 2 is an enlarged and exploded view of the stored-energy linkage of the present invention shown in FIG. 1.

When the removable hitch pin 65 is removed from the linkage retention position by wire 66 as shown in FIG. 2, the retention pin member 91 is disconnected from the looped end 105 of the second control cable 25, and the second valve control end 59 of lanyard 57 is disconnected from the second valve control cable 25. Upon being disconnected from the retention pin member 91, the looped end 105 pulls away from the fork member 81 thereby preventing actuation of the source 21 of encapsulating gas and preventing inflation of the encapsulating section 13.

Preferably the source of primary force 55 is a lid 55 for a container that stores the life raft system. As shown in FIG. 3, when the lid 55 falls away from the aviator during parachute descent, the falling lid 55 deploys the life raft system.

As shown in the exploded view of FIG. 2, the stored-energy releasable linkage 63 includes a fork member 81 including two arms 83 and 85, each of the arms including an aperture, namely apertures 87 and 89, respectively. Both o the apertures 87, 89 are in alignment for receipt of the retention pin member 91 which is inserted through the apertures. The retention pin member 91 includes a first end 93 including a pin hole 95 adapted to receive removable hitch pin 65. The retention pin member 91 also includes a shaft portion 99 and a second end including a head portion 101 adapted to retain a helical spring member 103 located between the head portion 101 and arm 83 of the fork member 81 when the removable hitch pin 65 is in the linkage retention position. The linkage retention position is shown in FIG. 1 wherein the linking between the second control cable 25 and the second arm member 57 is retained. As shown in FIG. 1, the shaft portion 99 of the retention pin member 91 is located inside the hollow cylindrical region of the spring member 103. Alternatively, a leaf spring or other suitable spring could be used.

When the spring 103 is retained in the linkage retention position, the spring is compressed to store energy. Retention of the compressed spring occurs when the spring 103 is located between the head portion 101 and the fork member 81.

When the hitch pin 65 is removed from the linkage retention position, the situation represented by the exploded view in FIG. 2, the spring 103 propels the retention pin member 91 away from the fork member 81; and the retention pin member 91 slides out of contact with a looped end 105 of the second control cable 25.

During assembly of the linkage assembly 63, the spring 103 is placed over the retention pin member 91 with one end of the spring 103 being retained by the head portion 101 of the retention pin 91. The pin hole end 93 and the shaft 99 are pushed through the aperture 87 in fork arm 83 thereby partially compressing the spring 103. When the pin hole end 93 of the retention pin 91 is located between the arms 83 and 85 of the fork member 81, the pin hole end 93 of the retention pin 91 is passed through the loop end 105 of the cable 25 for actuating the encapsulating gas source thereby linking the linkage assembly 63 with the encapsulating pressurized gas source. The retention pin member 91 is then pushed further and through the aperture 89 on the fork arm 85 thereby further compressing the spring 103 retained between the retention pin head 101 and the fork arm 83. Once the pin hole end 93 of the retention pin member 91 clears the aperture 89 of the fork arm 85, the hitch pin 65 is placed in position in the pin hole end 93, thereby locking the retention pin 91 in a linkage retention position whereby the spring 103 is retained in a compressed state.

However, when the hitch pin 65 is removed from the linkage retention position in the pin hole end 93, the spring 103 is released from its compressed state, and it propels the retention pin member 91 away from the fork member 81, whereby the retention pin member 91 slides out of contact with the loop end 105 of the cable 25 for actuating the encapsulating gas source, and the encapsulating gas source is disconnected from the actuating lanyard that is automatically actuated during parachute descent. It will be understood that various changes in the details, steps and arrangement of parts which have been herein described and illustrated to explain the nature of the invention, may be made by those skilled in the art within the principles and scope of the invention as expressed in the appended claims.

What is claimed is:

1. In an inflation system for a two-section raft for an aviator, wherein the first inflatable raft section is a main section and is inflated by a first pressurized source, wherein the second inflatable raft section is an encapsulating section and is inflated by a second pressurized source, wherein both raft sections are automatically inflated during parachute descent of the aviator by means for automatically actuating said raft sections, the improvement comprising:

an actuation system for the raft sections including a manually releasable energy-stored linkage assembly connected between the pressurized source for the encapsulating raft section and the automatic actuation means.

2. An actuation system for a two-section inflatable raft system for an aviator equipped with a parachute enabling descent of the aviator toward a body of water, the raft system including a main inflatable section and pressurized gas source therefor, an encapsulating inflatable section and pressurized gas source therefor, said actuation system comprising:

primary actuating means for actuating both inflatable sections by an element actuated during parachute descent of the aviator, said primary actuating means including a stored-energy releasable linkage means for providing a releasable connection between the encapsulating pressurized gas source and the element actuated during parachute descent, said stored-energy releasable linkage means including an energy storing element and a movable release member normally located in a linkage retention position; and secondary actuating means for being manually actuated by the aviator for deployment of the main raft section when the aviator is in the water, said secondary actuating means connecting a manual actuating element and the main section pressurized gas source and also connecting said manual actuating element with said movable release member, said secondary actuating means for moving said movable release member from the linkage retention position thereby releasing stored-energy in said energy storing element thereby separating the encapsulating pressurized gas source from the element actuated during parachute descent.

3. The actuation system described in claim 2 wherein the secondary actuating means further includes, a first arm member including a control end connected to the main pressurized source and including a tensioning end connected to a source of manually applied force creating tension in said first arm member, a second arm member including a movable release member end connected to said stored-energy movable release member, and including a tensioning end connected to the source of manually applied force creating tension in said second arm member, whereby, upon application of manually applied tension, said movable release member is moved from the linkage retention position and the stored-energy of said energy storing element is released, thereby breaking the connection between the encapsulating pressurized gas source and said second arm member.

4. The actuation system described in claim 2 wherein the primary actuating means includes, a first arm member including a valve control nd connected to the main pressurized gas source and including a primary tensioning end connected to the element actuated during parachute descent, creating tension in said first arm member, a second arm member including a valve control end connected to the encapsulating pressurized source and including a primary tensioning end connected to the element actuated during parachute descent, creating tension in said second arm member.

5. The actuation system described in claim 2 wherein said stored-energy releasable linkage means includes:

a fork member including two arms, each of said arms including an aperture, both of said apertures being in alignment for receipt of a retention pin member, a retention pin member inserted through said apertures, said retention pin member including a first end including a pin hole adapted to receive said movable release member, including a shaft portion, and including a second end including a head portion adapted to retain a spring member, a spring member located between said head portion of said retention pin member and one arm of said fork member when said movable release member is in the linkage retention position.

6. The actuation system described in claim 5 wherein said spring member is compressed to store energy when said spring member is located between said head portion and said fork member.

7. The actuation system described in claim 5 wherein said spring member propels said retention pin member away from said fork member when said movable release member is removed from the linkage retention position.

8. The actuation system described in claim 5 wherein said shaft portion of said retention pin member is inserted through said spring member.

9. The actuation system described in claim 8 wherein the encapsulating pressurized source includes a valve control means including a loop which is connected to said shaft portion of said retention pin member when said movable release member is in the linkage retention position, wherein said shaft portion connected to the loop is located between said arms of said fork member, whereby when said movable release member is removed from the linkage retention position, the loop is disconnected from said retention pin member when said retention pin member is propelled away from said arms of said fork member.

10. The actuation system described in claim 2 wherein the element that is actuated during parachute descent is a falling member that falls away from the aviator during parachute descent.

11. The actuation system described in claim 2 wherein said falling member is a raft container lid.

12. An actuation system for a two-section inflatable raft system for an aviator equipped with a parachute enabling descent of the aviator toward a body of water, wherein the inflatable raft system includes a main pressurized gas source, a main inflatable raft section, a first valve for permitting communication between the main pressurized gas source and the main inflatable raft section, first valve control means for controlling the first valve, an encapsulating pressurized gas source, an encapsulating inflatable raft section, a second valve for permitting communication between the encapsulating pressurized gas source and the encapsulating inflatable raft section, and second valve control means for controlling the second valve, said actuation system comprising:

primary actuating means for actuating both the first valve control means and the second valve control means when the aviator descends with a parachute, said primary actuating means including, a first arm member including a valve control end connected to the first valve control means and including a primary tensioning end connected to a source of primary force creating tension in said first arm member, a second arm member including a valve control end connected to the second valve control means, including a primary tensioning end connected to the source of primary force creating tension in said second arm member, and including a stored-energy releasable linkage assembly located between the second valve control means and said first arm member valve control end, said stored-energy releasable linkage assembly including an energy storing element and a movable release member normally located in a linkage retention position, and secondary actuating means for manually actuating the first valve control means and for moving said movable release member from the linkage retention position thereby releasing the stored-energy for said energy storing element and removing the linkage between the second valve control means and said second arm member, thereby preventing communication between the encapsulating pressurized gas source and the encapsulating inflatable raft section, said secondary actuating means including, a first arm member including a valve control end connected to the first valve control means and including a secondary tensioning end connected to a source of secondary force creating tension in said first arm member, a second arm member including a movable release member end connected to said stored-energy movable release member, and including a secondary tensioning end connected to a source of manual secondary force creating tension in said second arm member, whereby when said movable release member is moved from the linkage retention position the stored-energy for said energy storing element is released, the linkage between the second valve control means and said second arm member is removed, and the second valve control means is disconnected from said stored-energy releasable linkage assembly and said second arm member, thereby preventing release of pressure from said second pressurized gas source.

13. A two-section inflatable raft system for an aviator which includes a parachute enabling descent of the aviator to a body of water, said raft system comprising:

a main inflatable raft, a main pressurized gas source for inflating said main inflatable raft, main valve means for permitting communication between said main pressurized gas source and said main inflatable draft.

main valve control means for controlling said main valve means, encapsulating inflatable raft, an encapsulating pressurized gas source for inflating said encapsulating inflatable raft, encapsulating valve means for permitting communication between said encapsulating pressurized gas source and said encapsulating inflatable raft, encapsulating valve control means for controlling said encapsulating valve means, primary actuating means for actuating both said main valve control means and encapsulating valve control means when the aviator descends with a parachute, said primary actuating means including, a first arm member including a valve control end connected to said main valve control means and including a primary tensioning end connected to a source of primary force creating tension in said first arm member, a second arm member including a valve control end connected to said encapsulating valve control means, including a primary tensioning end connected to the source of primary force creating tension in said second arm member, and including a stored-energy releasable linkage assembly located between said encapsulating valve control means and said first arm member valve control end, said stored-energy releasable linkage assembly including an energy storing element and a movable retention member normally located in a linkage retention position, and secondary actuating means for manually actuating said main valve control means and for moving said movable retention member from the linkage retention position, thereby releasing the stored-energy for said energy storing element and removing the linkage between the second valve control means and said second arm member, thereby preventing communication between said encapsulating pressurized gas source and said encapsulating inflatable raft, said secondary actuating means including, a first arm member including a valve control end connected to said main valve control means and including a secondary tensioning end connected to a source of secondary force creating tension in said first arm member, a second arm member including a movable retention member end connected to said stored-energy movable retention member, and including a secondary tensioning end connected to a source of manual secondary force creating tension in said second arm member, whereby when said movable retention member is moved from the linkage retention position the stored-energy for said energy storing element is released, the linkage between the second valve control means and said second arm member is removed, and said encapsulating valve control means is disconnected from said stored-energy releasable linkage assembly and said second arm member, thereby preventing release of pressure from said encapsulating pressurized gas source.

14. An apparatus for selectively actuating one or two outputs, said apparatus comprising:

primary actuating means connected to both outputs and for actuating both of the outputs, said primary actuating means including, a first arm member including a first output control end connected to the first output and including a primary tensioning end connected to a source of primary force creating tension in said first arm member, a second arm member including a second output control end connected to the second output, including a primary tensioning end connected to the source of primary force creating tension in said second arm member, and including a stored-energy releasable linkage means located between the second output and said second arm member output control end, said stored-energy releasable linkage means including a movable release member normally located in a linkage retention position, and secondary actuating means connected to only the first output and for only the first output, and for moving said movable re member from the linkage retention position, said actuating means including, a first arm member including a first output control end connected to the first output and including a secondary tensioning end connected to a source of secondary force creating tension in said first arm member, a second arm member including a movable release member end connected to said stored-energy movable release member, and including a secondary tensioning end connected to a source of secondary force creating tension in said second arm member, whereby when said movable release member is moved from the linkage retention position, the second output is disconnected from said stored-energy releasable linkage means and said second arm member thereby preventing operation of the second output.

* * * * *